US011337281B2

(12) United States Patent
Wei

(10) Patent No.: US 11,337,281 B2
(45) Date of Patent: May 17, 2022

(54) APPLICATION APPARATUS COMBINING LED DIMMER AND REACTOR

(71) Applicant: SHENZHEN HONTECH-WINS ELECTRONICS CO., LTD, Guangdong (CN)

(72) Inventor: Wencai Wei, Guangdong (CN)

(73) Assignee: SHENZHEN HONTECH-WINS ELECTRONICS CO., LTD, Guangdong (CN)

( * ) Notice: Subject to any disclaimer, the term of this patent is extended or adjusted under 35 U.S.C. 154(b) by 0 days.

(21) Appl. No.: 16/982,620

(22) PCT Filed: May 7, 2019

(86) PCT No.: PCT/CN2019/085855
§ 371 (c)(1),
(2) Date: Sep. 21, 2020

(87) PCT Pub. No.: WO2020/155456
PCT Pub. Date: Aug. 6, 2020

(65) Prior Publication Data

US 2021/0307136 A1 Sep. 30, 2021

(30) Foreign Application Priority Data

Jan. 28, 2019 (CN) ..... 201920147911.5

(51) Int. Cl.
*H05B 45/10* (2020.01)
*H05B 45/37* (2020.01)
*H05B 45/50* (2022.01)

(52) U.S. Cl.
CPC ..... *H05B 45/10* (2020.01); *H05B 45/37* (2020.01); *H05B 45/50* (2020.01)

(58) Field of Classification Search
None
See application file for complete search history.

(56) References Cited

U.S. PATENT DOCUMENTS 3,500,124 A * 3/1970 Babcock ..... H05B 39/083 315/200 R
10,080,273 B1 * 9/2018 Slivka ..... H02M 1/32
(Continued)

FOREIGN PATENT DOCUMENTS

CN 205610981 U 9/2016
CN 108271297 A 7/2018
(Continued)

OTHER PUBLICATIONS

International Search Report dated Oct. 19, 2019, issued in application No. PCT/CN2019/085855.

*Primary Examiner* — Anh Q Tran
(74) *Attorney, Agent, or Firm* — McClure, Qualey & Rodack, LLP

(57) ABSTRACT

An application apparatus combining LED dimmer and reactor, comprises power supply, dimming control circuit, reactor circuit and voltage converting circuit. Output end of the power supply is connected to the dimming control circuit, output end of the dimming control circuit to the reactor circuit, output end of the reactor circuit to the voltage converting circuit, and output end of the voltage converting circuit to electrical loads. In the present invention, a utility frequency reactor is series connected between the output end of the dimmer and the dimmable LED light, and a R.C peak voltage absorption circuit is parallel connected to both ends of the reactor. By switching the phase angle on and off, it is possible to adjust level of output voltage and make light adjustment. Meantime, harmonic current is reduced, and electric grid pollution and line loss relieved, finally energy is saved and pollution is controlled.

4 Claims, 2 Drawing Sheets

(56) References Cited

U.S. PATENT DOCUMENTS

| | | | | |
|---|---|---|---|---|
| 10,340,692 | B2 * | 7/2019 | Testani | H05B 45/10 |
| 2011/0057578 | A1 * | 3/2011 | Otake | H05B 45/3575 315/291 |
| 2013/0229121 | A1 * | 9/2013 | Otake | H05B 45/385 315/200 R |
| 2014/0333228 | A1 * | 11/2014 | Angeles | H02M 7/2176 315/291 |
| 2015/0319820 | A1 * | 11/2015 | Puvanakijjakorn | H05B 45/20 315/297 |

FOREIGN PATENT DOCUMENTS

| | | | |
|---|---|---|---|
| CN | 208282876 | U | 12/2018 |
| GB | 2018532 | A | 10/1979 |

* cited by examiner

APPLICATION APPARATUS COMBINING LED DIMMER AND REACTOR

CROSS-REFERENCE OF RELATED APPLICATIONS

The present invention claims the priority of the Chinese Patent application CN 201920147911.5 filed at Jan. 28, 2019, the entire content of this priority are incorporated herein by reference.

TECHNICAL FIELD

The present invention relates to the field of LED dimmer, more specifically to an application apparatus combining LED dimmer and reactor.

BACKGROUND TECHNOLOGY

During dimming with output voltage between 30%-70%, LED driver switching power supply shows apparent capacitive load characteristics, wherein current phase leads, power factor reduces, harmonic current increase and current peak multiplies which will result in dimmer easy damage. In addition, it will also bring interference to electrical grid, speed up line deterioration and cause line heating, posing threat to electrical grid.

SUMMARY OF INVENTION

The technical problem to be addressed by the present invention is that an electrical appliance of an LED dimmer working in conjunction with line reactor aiming at the deficiency of the existing technology.

The technical solution adopted by the present invention is as follows, an application apparatus combining LED dimmer and reactor, including power supply, a dimming control circuit, an line reactor circuit and a voltage converting circuit, wherein output end of the power supply is connected to a dimming control circuit, output end of the dimming control circuit is connected to the line reactor circuit, output end of the line reactor circuit is connected to the voltage converting circuit, and output end of the voltage converting circuit is connected to electrical loads.

As a further technical solution of the present invention, the line reactor circuit includes a first peak absorption circuit composed of a first electrical inductor, a second capacitor, and a second resistor, and a second peak absorption circuit composed of a third capacitor and a third resistor, first end of the first electrical inductor is connected to output end of the dimming control circuit, and second end of the first electrical inductor is connected to the voltage converting circuit; the second capacitor and the second resistor are series connected and parallel connected to both ends of the first electrical inductor; the third capacitor and the third resistor are connected in series and then are connected in parallel to the power supply lines.

As a further technical solution of the present invention, the power supply is an AC power supply, and an output end of the AC power supply is connected in parallel with a first filter capacitor, and a fuse is provided on one of lines of the AC power supply.

As a further technical solution of the present invention, the dimming control circuit includes a pulse signal generator, a varistor, a first resistor, a first capacitor, and a power control circuit; one end of the varistor is connected to output end of the fuse, and second end of the varistor is connected to the line reactor circuit, the first resistor and the first capacitor are connected in series and then in parallel to both ends of the varistor, output end of the pulse signal generator is connected to a power control circuit, and output end of the power control circuit is connected to the varistor.

As a further technical solution of the present invention, the power control circuit adopts a first field effect transistor and a second field effect transistor, the grids of the first field effect transistor and the second field effect transistor are connected to output end of the phase signal generator, the drain of the first field effect transistor and the drain of the second field effect transistor are respectively connected to both ends of the varistor.

As a further technical solution of the present invention, the power control circuit is a thyristor, control end of the thyristor is connected to output end of the phase signal generator, input end and output end of the thyristor are respectively connected to both ends of the varistor.

As a further technical solution of the present invention, the power control circuit is insulate-gate bipolar transistor.

As a further technical solution of the present invention, the first inductor is wound with silicon steel sheet and enameled wire.

Further, the inductance of the first electrical inductor is 1 mH-10 mH.

Further dimming power of the dimming control circuit is 500 W-5000 W.

Beneficial effects of present invention are as follows, in the present invention, a utility frequency line reactor is series connected between the output end of the dimmer and the dimmable LED light, and a R.C peak voltage absorption circuit is parallel connected to both ends of the line reactor. By switching the phase angle on and off, it is possible to adjust level of output voltage and make light adjustment. In the meantime, harmonic current is reduced, and consequently electric grid pollution and line loss relieved, and finally energy is saved and pollution is controlled.

SPECIFIC EMBODIMENTS

Figure 1:
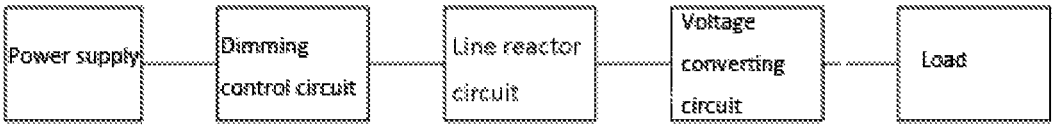
FIG. 1 is a structural view of an application apparatus combining LED dimmer and reactor proposed in the present invention.

The present invention is described in details below with reference to the embodiments shown in the drawings, but it should be noted that these embodiments do not limit the present invention, and equivalent transformations or substitutions of the functions, methods, or structural features made by those skilled in the art according to these embodiments shall fall within the scope of protection of the present invention.

Referring to FIG. 1, it is a structural view of an application apparatus combining LED dimmer and reactor disclosed by the present invention.

As shown in FIG. 1, an application apparatus combining LED dimmer and reactor, includes a power supply, a dimming control circuit, an line reactor circuit and a voltage converting circuit, wherein output end of the power supply is connected to a dimming control circuit, output end of the dimming control circuit is connected to the inductor circuit, output end of the line reactor circuit is connected to the voltage converting circuit, output end of the voltage converting circuit is connected to electrical loads.

In an animal and plant lighting AC dimming system, a power frequency line reactor wound with silicon steel sheet is connected in series between output of the dimmer and the dimmable LED light, the inductance of the electrical inductor is between 1 mH-10 mH according to load power. And both ends of the electrical inductor are connected in parallel with the R.C peak voltage absorption circuit.

By switching the phase angle on and off, output voltage is adjusted so that the dimming purpose is achieved.

The line reactor circuit includes a first peak absorption circuit composed of a first electrical inductor L1, a second capacitor C2, and a second resistor R2, and a second peak absorption circuit composed of a third capacitor CX2 and a third resistor R3, wherein the third capacitor CX2 and the third resistor R3 are used to absorb the ringing and voltage spike generated during phase cut dimming. The first end of the first electrical inductor L1 is connected to the output end of the dimming control circuit, and the second end of the first electrical inductor L1 is connected to a voltage converting circuit; the second capacitor C2 and the second resistor R2 are connected in series and then are connected in parallel to both ends of the first electrical inductor L1; and the third capacitor CX2 and the third resistor R3 are connected in series and then are connected in parallel on the power supply line.

The power supply is an AC power supply, and an output end of the AC power supply is connected in parallel with a first filter capacitor CX1, and a fuse F1 is provided on one of lines of the AC power supply.

The dimming control circuit includes a pulse signal generator, a varistor RV 1, a first resistor R1, a first capacitor C1, and a power control circuit; one end of the varistor RV1 is connected to output end of the fuse F1, and the second end of the varistor RV1 is connected to the inductor circuit, the first resistor R1 and the first capacitor C1 are connected in series and then are connected in parallel at both ends of the varistor RV1, the output end of the pulse signal generator is connected to a power control circuit, the output end of the power control circuit is connected to the varistor RV1.

Figure 2:
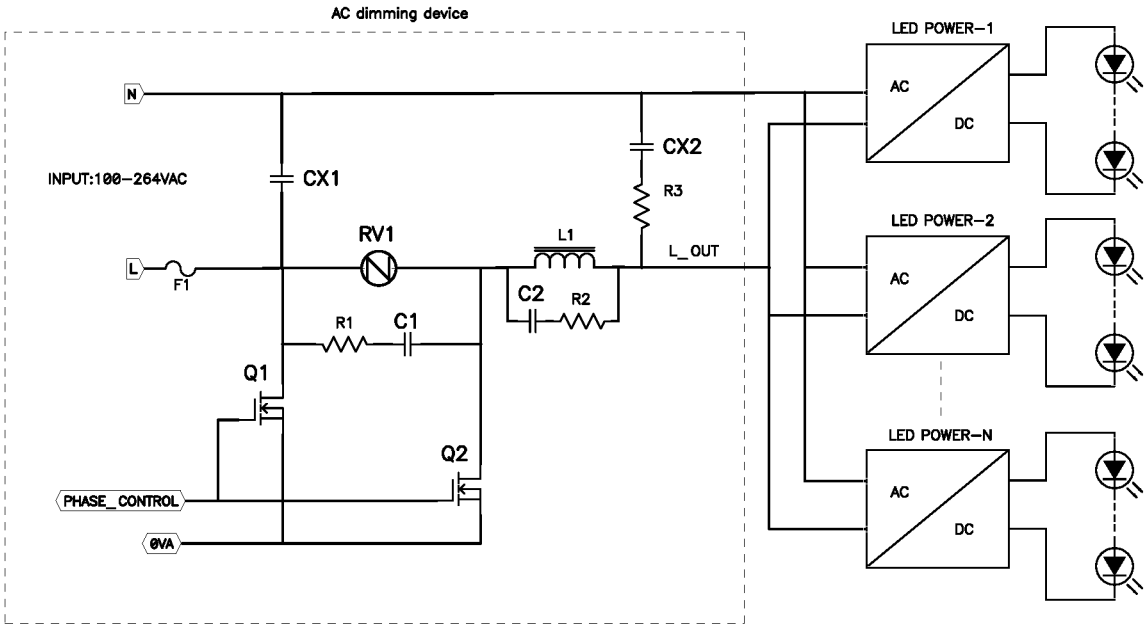
FIG. 2 is a structural view of one embodiment proposed in the present invention.

Referring to FIG. 2, the power control circuit includes a first field effect transistor Q1 and a second field effect transistor Q2, grids of the first field effect transistor Q1 and the second field effect transistor Q2 are connected to the output end of the phase signal generator, and drain of the first field effect transistor Q1 and drain of the second field effect transistor Q2 are respectively connected to both ends of the varistor RV1.

A dimmer of 2200 W is taken as an example herein, the phase generator sends a phase control signal to turn on the first field effect transistor Q1 and the second field effect transistor Q2 when the phase angle is about 120 degrees, then the current passes the bridge rectifiers in the LED power supply and gets to the CBB capacitor, wherein dozens to more than 200 LED lights are connected in parallel, each light ranges from 6 W-35 W and the capacitance is usually tens of uF. As the capacitor voltage could not be changed abruptly and it is equivalent to a constant current source, the charging current could, increase sharply, thereby producing a high peak current which is rich in high harmonic current. Due to the inductance characteristics of line reactors, i.e. the current could not be abruptly changed, equivalent to a constant current source, that the line reactor connected in series with output circuit of dimmer would smooth and suppress large spikes down. And the varistor RV1 absorbs electrical surges in the grid.

Figure 3:
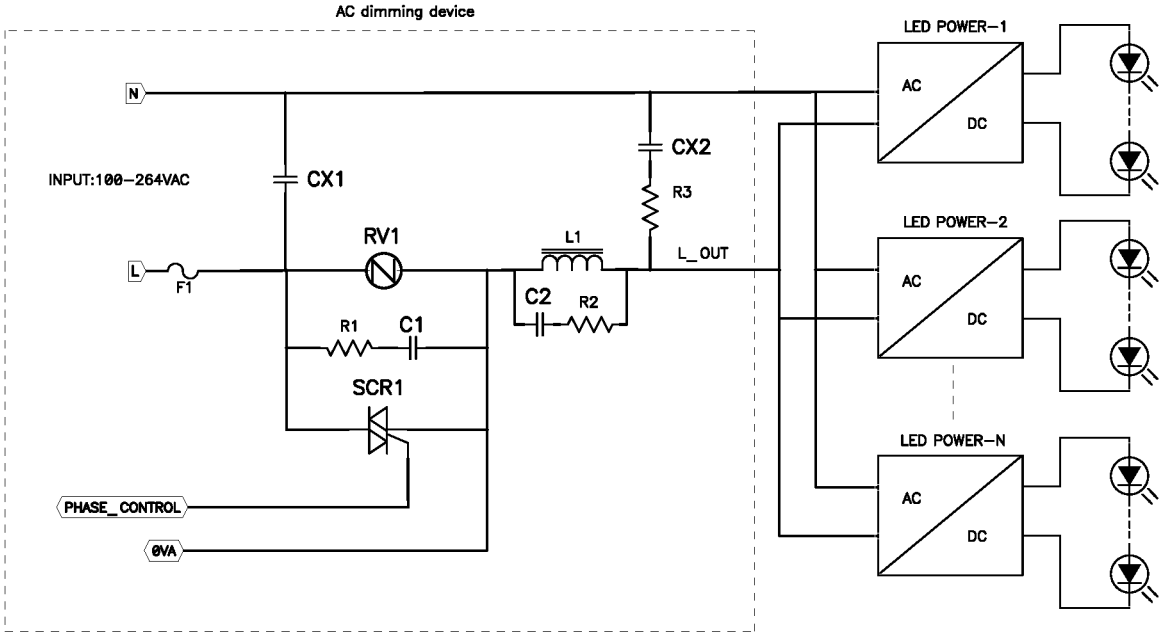
FIG. 3 is a structural view of one embodiment proposed in the present invention.

Referring to FIG. 3, the power control circuit is thyristor, control end of the thyristor is connected to the output end of the phase signal generator, and input end and output end of the thyristor are respectively connected to both ends of the varistor.

Figure 4:
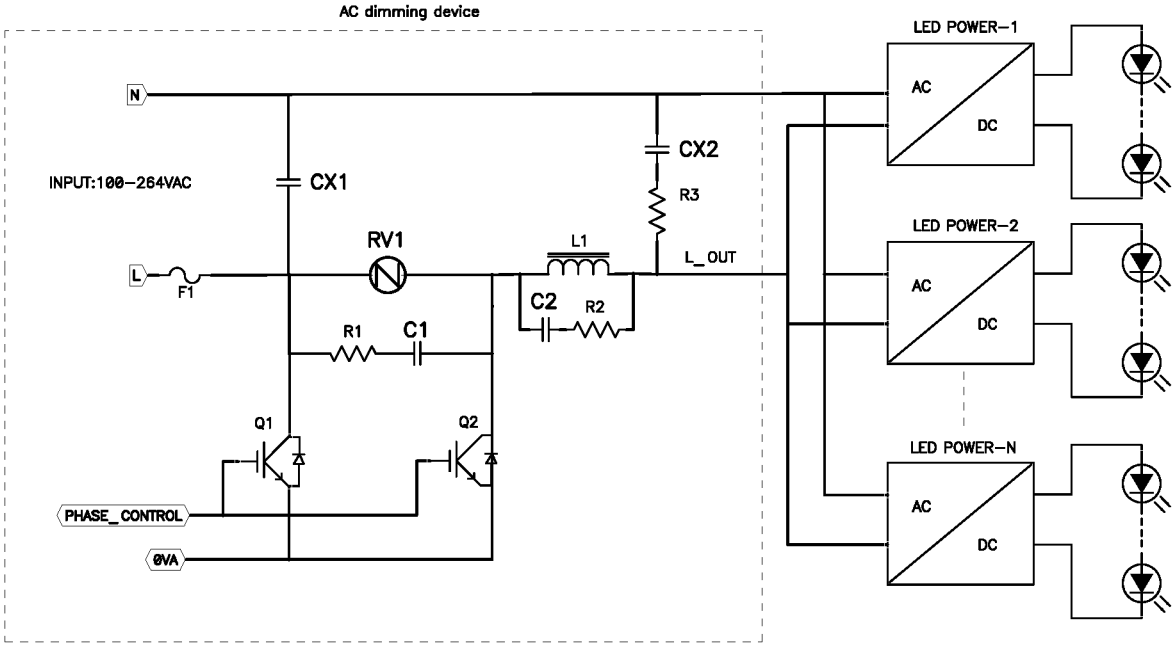
FIG. 4 is a structural view of one embodiment proposed in the present invention.

Referring to FIG. 4, the power control circuit is insulated-gate bipolar transistor.

The first electrical inductor L1, the second capacitor C2 and the second resistor R2 form a peak absorption circuit, wherein the first electrical inductor L1 is a power frequency inductance, wound with silicon steel sheet and enameled wire, and the dimmer is 500 W-5000 W, the inductance of the inductor is 1 mH-10 mH.

By series connection of power frequency inductor device, according to the formula for calculating inductance current i.e. $\Delta I=(Vin-Vo)*Ton/L$, it shall be understood that under the same conditions when the values of Vin, Vo, and Ton are kept unchanged, the value increase of L would lead the value decrease of $\Delta I$. Therefore the arrangement of line reactor will significantly reduce the peak current in the dimming range of 30%-70%, and reduce the harmonic current, thereby effectively lowering the calorific value, and maintaining the high reliability of the dimmer.

Due to the input magnetic ring inductor in the dimmer, according to the formula for calculating the magnetic field strength, i.e. $H=NI/Ie$, the greater the peak value of I is, the stronger the H is, resonance occurs between the inductor coil and the magnetic core, and audible noise is emitted. Vice versa, the lower the peak value of I and the weaker the H, less resonance of the inductor and noise could be heard. Therefore, while reducing the harmonic current, it also effectively reduces the audible noise of dimming in the range of 30%-70%.

The present invention reduces the harmonic current, correspondingly reduces grid pollution and line loss, and achieves energy saving and emission reduction purpose.

Basic principles, main features and advantages of the present invention are shown and described above. Those skilled in the art shall be aware that the present invention is not restricted by the above embodiments. Instead, without departing from the spirit and scope of the present invention, the present invention will have various changes and improvements, and these changes and improvements shall fall within the scope of protection of the claimed invention. The claimed protection scope of the present invention is defined by the appended claims and their equivalents.

The invention claimed is:

1. An application apparatus combining LED dimmer and reactor, including a power supply, a dimming control circuit, an line reactor circuit and a voltage converting circuit, wherein output end of the power supply is connected to a dimming control circuit, output end of the dimming control circuit is connected to the line reactor circuit, output end of the line reactor circuit is connected to the voltage converting circuit, and output end of the voltage converting circuit is connected to electrical loads;

wherein the power supply is an AC power supply, and an output end of the AC power supply is connected in parallel with a first filter capacitor, and a fuse is provided on one of lines of the AC power supply;

wherein the line reactor circuit includes a first peak absorption circuit composed of a first electrical inductor, a second capacitor, and a second resistor, and a second peak absorption circuit composed of a third capacitor and a third resistor, first end of the first electrical inductor is connected to output end of the dimming control circuit, and second end of the first electrical inductor is connected to the voltage converting circuit;

the second capacitor and the second resistor are series connected and parallel connected to both ends of the first electrical inductor; and the third capacitor and the third resistor are connected in series and then are connected in parallel to the power supply lines.

2. An application apparatus combining LED dimmer and reactor, including a power supply, a dimming control circuit, an line reactor circuit and a voltage converting circuit, wherein output end of the power supply is connected to a dimming control circuit, output end of the dimming control circuit is connected to the line reactor circuit, output end of the line reactor circuit is connected to the voltage converting circuit, and output end of the voltage converting circuit is connected to electrical loads;

wherein the power supply is an AC power supply, and an output end of the AC power supply is connected in parallel with a first filter capacitor, and a fuse is provided on one of lines of the AC power supply;

wherein the line reactor circuit includes a first peak absorption circuit composed of a first electrical inductor, a second capacitor, and a second resistor, and a second peak absorption circuit composed of a third capacitor and a third resistor, first end of the first electrical inductor is connected to output end of the dimming control circuit, and second end of the first electrical inductor is connected to the voltage converting circuit;

the second capacitor and the second resistor are series connected and parallel connected to both ends of the first electrical inductor;

the third capacitor and the third resistor are connected in series and then are connected in parallel to the power supply lines; and wherein the dimming control circuit includes a pulse signal generator, a varistor, a first resistor, a first capacitor, and a power control circuit; one end of the varistor is connected to output end of the fuse, and second end of the varistor is connected to the line reactor circuit, the first resistor and the first capacitor are connected in series and then in parallel to both ends of the varistor, output end of the pulse signal generator is connected to a power control circuit, and output end of the power control circuit is connected to the varistor.

3. An application apparatus combining LED dimmer and reactor, including a power supply, a dimming control circuit, an line reactor circuit and a voltage converting circuit, wherein output end of the power supply is connected to a dimming control circuit, output end of the dimming control circuit is connected to the line reactor circuit, output end of the line reactor circuit is connected to the voltage converting circuit, and output end of the voltage converting circuit is connected to electrical loads;

wherein the power supply is an AC power supply, and an output end of the AC power supply is connected in parallel with a first filter capacitor, and a fuse is provided on one of lines of the AC power supply;

wherein the line reactor circuit includes a first peak absorption circuit composed of a first electrical inductor, a second capacitor, and a second resistor, and a second peak absorption circuit composed of a third capacitor and a third resistor, first end of the first electrical inductor is connected to output end of the dimming control circuit, and second end of the first electrical inductor is connected to the voltage converting circuit;

the second capacitor and the second resistor are series connected and parallel connected to both ends of the first electrical inductor;

the third capacitor and the third resistor are connected in series and then are connected in parallel to the power supply lines;

wherein the dimming control circuit includes a pulse signal generator, a varistor, a first resistor, a first capacitor, and a power control circuit; one end of the varistor is connected to output end of the fuse, and second end of the varistor is connected to the line reactor circuit, the first resistor and the first capacitor are connected in series and then in parallel to both ends of the varistor, output end of the pulse signal generator is connected to a power control circuit, and output end of the power control circuit is connected to the varistor;

wherein the power control circuit adopts a first field effect transistor and a second field effect transistor, the grids of the first field effect transistor and the second field effect transistor are connected to output end of the phase signal generator, the drain of the first field effect transistor and the drain of the second field effect transistor are respectively connected to both ends of the varistor;

wherein the power control circuit is insulated-gate bipolar transistor;

wherein the power control circuit is a thyristor, control end of the thyristor is connected to output end of the phase signal generator, input end and output end of the thyristor are respectively connected to both ends of the varistor; and wherein the first electrical inductor is wound with silicon steel sheet and enameled wire.

4. An application apparatus combining LED dimmer and reactor, including a power supply, a dimming control circuit, an line reactor circuit and a voltage converting circuit, wherein output end of the power supply is connected to a dimming control circuit, output end of the dimming control circuit is connected to the line reactor circuit, output end of the line reactor circuit is connected to the voltage converting circuit, and output end of the voltage converting circuit is connected to electrical loads;

wherein the power supply is an AC power supply, and an output end of the AC power supply is connected in parallel with a first filter capacitor, and a fuse is provided on one of lines of the AC power supply;

wherein the line reactor circuit includes a first peak absorption circuit composed of a first electrical inductor, a second capacitor, and a second resistor, and a second peak absorption circuit composed of a third capacitor and a third resistor, first end of the first electrical inductor is connected to output end of the dimming control circuit, and second end of the first electrical inductor is connected to the voltage converting circuit;

the second capacitor and the second resistor are series connected and parallel connected to both ends of the first electrical inductor;

the third capacitor and the third resistor are connected in series and then are connected in parallel to the power supply lines;

wherein the dimming control circuit includes a pulse signal generator, a varistor, a first resistor, a first capacitor, and a power control circuit; one end of the varistor is connected to output end of the fuse, and second end of the varistor is connected to the line reactor circuit, the first resistor and the first capacitor are connected in series and then in parallel to both ends of the varistor, output end of the pulse signal generator is connected to a power control circuit, and output end of the power control circuit is connected to the varistor;

wherein the power control circuit adopts a first field effect transistor and a second field effect transistor, the grids of the first field effect transistor and the second field effect transistor are connected to output end of the phase signal generator, the drain of the first field effect transistor and the drain of the second field effect transistor are respectively connected to both ends of the varistor;

wherein the power control circuit is insulated-gate bipolar transistor;

wherein the power control circuit is a thyristor, control end of the thyristor is connected to output end of the phase signal generator, input end and output end of the thyristor are respectively connected to both ends of the varistor;

wherein the first electrical inductor is wound with silicon steel sheet and enameled wire; and wherein the inductance of the first electrical inductor is 1 mH-10 mH.

* * * * *